US005109612A

United States Patent [19]

Timm

[11] Patent Number: 5,109,612

[45] Date of Patent: May 5, 1992

[54] ASPIRATED SYPHON SHOE

[75] Inventor: Gerald L. Timm, Schoolcraft, Mich.

[73] Assignee: The Johnson Corporation, Three Rivers, Mich.

[21] Appl. No.: 622,957

[22] Filed: Dec. 6, 1990

[51] Int. Cl.[5] ..... D06F 58/00

[52] U.S. Cl. ..... 34/119; 34/124; 34/125

[58] Field of Search ..... 34/119, 124, 125; 165/89, 90

[56] References Cited

U.S. PATENT DOCUMENTS

| | | | |
|---|---|---|---|
| 2,993,282 | 7/1961 | Daane et al. | 34/125 |
| 3,943,638 | 3/1976 | Robson | 34/124 |
| 4,384,412 | 5/1983 | Chance et al. | 34/119 |
| 4,498,249 | 2/1985 | Cooke et al. | 34/119 |
| 4,501,075 | 2/1985 | Jenkner et al. | 34/125 |
| 4,516,334 | 5/1985 | Wanke | 34/124 |
| 4,606,136 | 8/1986 | Pflug | 34/125 |
| 4,691,452 | 9/1987 | Ferguson | 34/119 |
| 4,718,177 | 1/1988 | Haeszner et al. | 34/119 |
| 5,020,243 | 6/1991 | Miller et al. | 34/119 |

FOREIGN PATENT DOCUMENTS 2413271 10/1974 Fed. Rep. of Germany .

*Primary Examiner*—Henry A. Bennet
*Assistant Examiner*—Denise L. F. Gromada
*Attorney, Agent, or Firm*—Beaman & Beaman

[57] ABSTRACT

A low differential pressure rotary syphon for the purpose of removing condensate from the interior of steam a heated dryer drum under low differential pressure conditions. The reduction in the magnitude of differential pressure required to remove the condensate is accomplished through the direct introduction of steam into a central plenum area receiving condensate thereby reducing the mass density of the condensate mixture. The reduction in mass density and the steam introduced acting directly on the condensate within the central plenum area facilitates the removal of the condensate from the drying drum interior.

8 Claims, 1 Drawing Sheet

ASPIRATED SYPHON SHOE

BACKGROUND OF THE INVENTION

The invention relates to a low differential pressure syphon assembly for steam heated rotary dryer drums and particularly pertains to a pick-up shoe for a rotating syphon assembly.

The condensate removal means requirements in a high speed rotating drum application differ from those of stationary or low speed rotating drum applications. In the art of steam dryer drums for paper machines and the like, syphon pipes have long been used to remove the condensate from the drum and means to aid condensate pick-up such as scoops and flow directional means are commonly used with stationary syphon pipes where the condensate is removed from the lowest part of the drum. Rotating syphons are used in applications where due to the higher rotational speed of the drying drum, the condensate is distributed in a more or less uniform layer on the entire interior circumference of the drying drum because of centrifugal force. In these high rotational speed applications, the centrifugal force also frustrates condensate removal from the drum interior wall.

Typically, a steam heated rotary syphon handles both a vapor and a fluid; the vapor being inadvertently introduced into the syphon as the condensate is drawn into the syphon. The pressure loss characteristics of a conventional rotary syphon do not exhibit a monotonic behavior with the vapor mass flow. At high flow rates the vapor mass flow causes a pressure loss which increases quadratically as the flow increases. On the other hand, at low flow rates, the density of the mixture increases and a pressure loss occurs in lifting the mixture through the syphon assembly to the rotational axis of the drum against the centrifugal force acting on the condensate. Also, if the condensate flow ceases for a sufficient period, the fluid level inside the roll will increase and the syphon entrance will be covered necessitating a large differential pressure to move a dense fluid column.

Syphons aspirated with steam have been used to augment condensate removal and United States patents disclosing aspirated rotating syphons include U.S. Pat. Nos. 4,718,177; 4,606,136; 4,516,334; 2,993,282 and British specification No. 2,413,271 also discloses another example of an aspirated syphon. Each of the aforementioned patents incorporate a flow directing means within a pick up tip unlike the invention's novel open condensate flow path design. The pressure losses attendant to designs of this type require the application of a compensatorally higher differential pressure to remove the condensate from the drum.

U.S. Pat. No. 4,718,177 employs a flow directional means in its design in the form of a steam blow line with a triangular cross-section. This patent combines the redirecting effect of the triangle, the base of which is parallel to the longitudinal axis of the drying drum and a jet pump effect is accomplished through the injection of steam into and in the direction of condensate flow from a plurality of holes in the apex of the redirecting device positioned in an elongated slot in the cylindrical condensate pickup means.

Some conventional steam aspirated syphons incorporate a small vapor injection port, typically, on the order of 0.05 square inches located at a radial position displaced toward the cylinder centerline from the syphon tip. These patents have vapor introduced at such a location that it does not act on the drum wall fluid interface and, consequently, is much less effective in assisting the fluid discharge. U.S. Pat. Nos. 2,993,282, 4,606,136 and the British disclosure No. 241,171 are of this manufacture. With these devices the steam injection port does not convey vapor into and counter to the condensate flow for reducing the mixture density. Mixture density reduction enhances condensate removal efficiency which is especially important to offset the increase in pressure loss at low flows. Another inherent limitation of small holes is that they offer minimal assistance in reducing the mixture density if the tip is covered by condensate.

An object of the invention is to provide a rotating dryer drum syphon adapted to more effectively remove the condensate at lower differential pressures than conventional rotary syphons.

Another object of the invention is to provide a rotary syphon which prevents flooding of the steam ports within design limits of the invention.

SUMMARY OF THE INVENTION

The construction of a low differential pressure rotary syphon in accord with the invention has two basic features which improve its operational characteristics. First, a large annular channel defines a steam port for directing steam radially toward the syphon centerline and conducts vapor from the cylinder into the syphon pickup area. The area of this channel is significantly larger than that of the injectors of prior art patents allowing more steam flow resulting in a greater condensate removal rate due to a substantial reduction in condensate mixture density. The second basic feature of the invention is the introduction of steam flow into the tip region where it acts directly oh the condensate thereby assisting in its aspiration from the drum cavity; these features, as well as the invention's introduction of the condensate into the syphon central plenum through a separate channel, thereby achieve the desired condensate removal rate at lower operating differential pressures.

Specifically, the invention accomplishes the above by forming a condensate flow path disposed adjacent to the drum shell and a central plenum receiving condensate. An annular core coaxially located within the syphon foot defines a substantially annular injection port having an inlet in communication with the drum interior and an outlet directed toward the foot plenum. The annular port is defined by a spacing between the core and the foot maintained and determined ,y core projections.

A syphon pipe communicates with the foot plenum through the core and an annular extension on the foot radially spaced from the core defines a well having an access edge remotely spaced from the foot flow path to prevent condensation from entering the well. The port inlet communicates with the well.

The existing differential pressure in the drum and syphon pipe causes condensate to flow between the foot condensate flow surface and the drum and into the foot central plenum. As the condensate enters the central plenum steam from the annular port is mixed with the condensate, and this lower density mixture is readily removed through the condensate siphon pipe. The combination of lower mixture density and the direct action of the steam upon the condensate enable the invention to remove greater amounts of condensate at a significantly lower differential pressure than conventional syphons.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
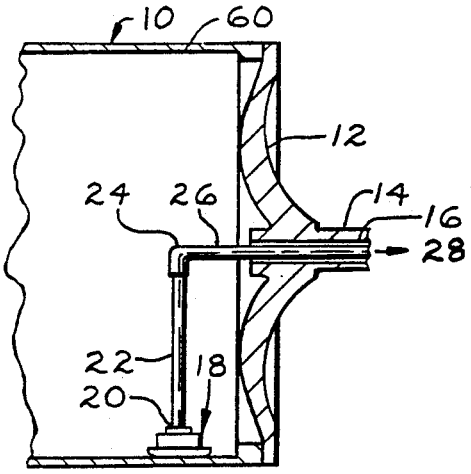
FIG. 1 is a partial elevational, partly in cross-section diametrical view as taken through a drying drum rotational axis showing the syphon system within a drying drum.
Figure 5:
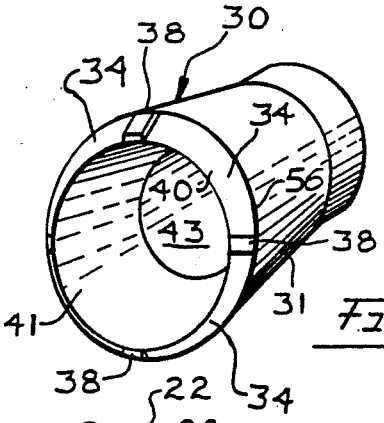
FIG. 5 is a perspective end view of the syphon shoe core showing the annular steam injection port area of the core.

In FIG. 1 a typical steam heated drying drum is shown in cross-section with the rotary low differential pressure syphon assembly of the invention installed in a typical manner. The rotary drying drum main elements include a cylindrical shell 10, two end heads of which one is shown at 12, each with a bearing journal 14, at least one of which has an axial bore, as shown in FIG. 1 at 16 through which the live steam can enter and through which the condensate mixture can be withdrawn. The condensate is removed through the syphon shoe 18 of the invention in communication with the socket connection 20, in communication with a radial syphon conduit 22, and the elbow 24 in communication with the radial conduit 22 and an axial conduit 26 which passes through a rotary joint, not shown and ultimately to a collection means 28.

A syphon shoe 18 in accord with the invention includes a central annular core 30 and an annular foot 32. The core includes an annular conical surface 34 which is maintained in a uniform spaced relationship to the conical surface 36 defined on the foot 32 by four spacer projections 38 extending from the core surface 34 at 90 degree spacings from each other. The spacer projections 38 may be welded to surface 34, or may be formed of the metal of the core 30, and are also welded to the foot 32 to maintain the assembly of the core and foot.

Figure 2:
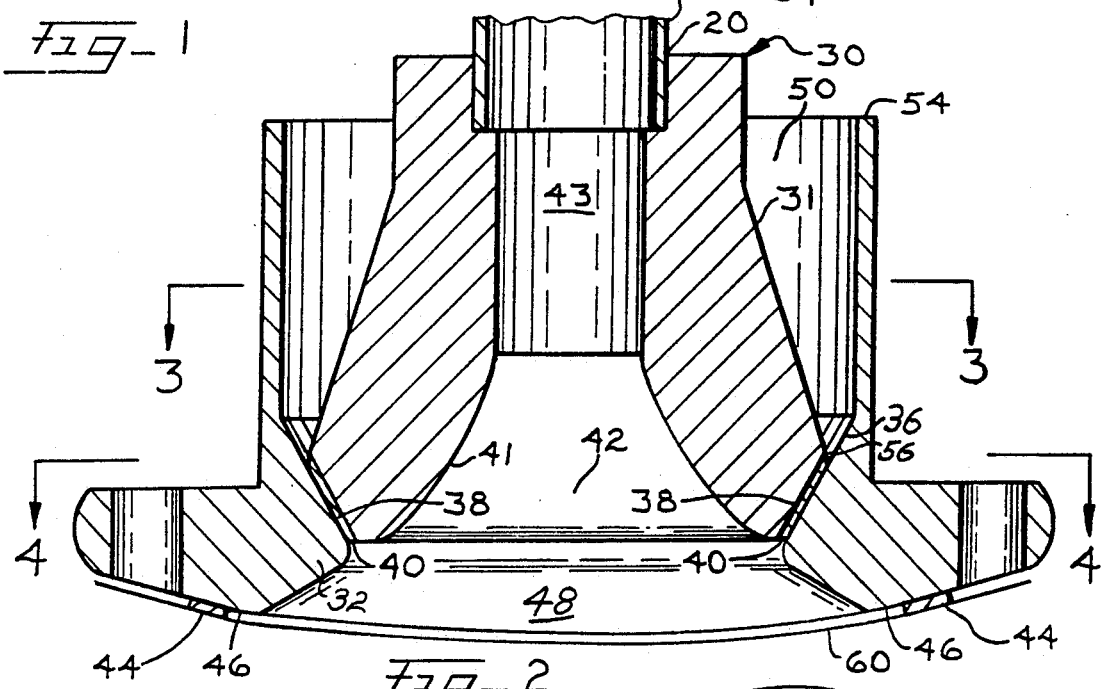
FIG. 2 is an enlarged elevational, diametrical cross-sectional view as taken along the syphon shoe longitudinal axis.
Figure 3:
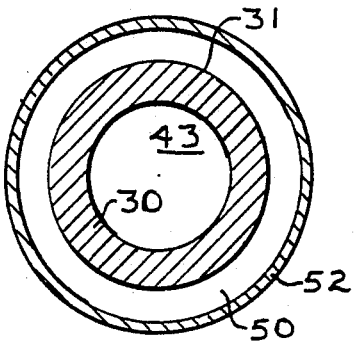
FIG. 3 is a reduced cross-sectional plan view as taken along Section 3—3 of FIG. 2.
Figure 4:
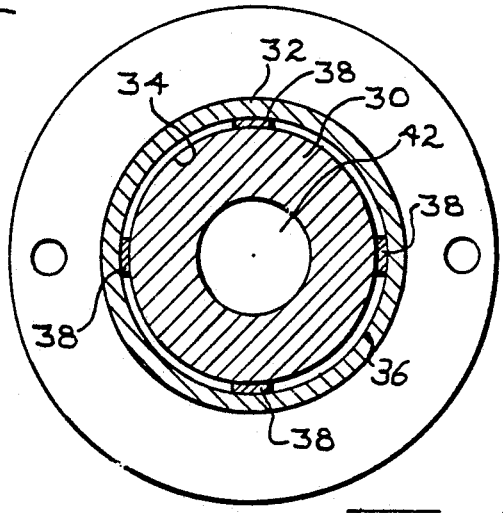
FIG. 4 is a cross-sectional plan view as taken along Section 4—4 of FIG. 2.

The spaced conical surfaces 34 and 36 together define a steam injection port having an annular port outlet at 40, FIG. 2. While the spacer projections 38 interrupt the true continuous annular configuration of the outlet 40, the circumferential dimensions of the projections is small compared to the entire circumference of the port outlet.

The core 30 includes an axially extending bore having a generally convex conical surface 41 which defines a central plenum area 42. The conical bore portion 43 communicates with plenum area 42 and the syphon pipe socket connection 20 permitting the central plenum area to be evacuated through the syphon conduits 22 and 26.

Small spacer legs 44 are formed on the foot convex condensate flow surface 46 to maintain the desired spacing between the syphon shoe 18 and the drum interior surface 60 to control the desired thickness of condensate within the drum shell. The flow surface 46 is shaped to conform to the radius of the drum shell surface 60.

Internally, the foot 32 includes the condensate flow opening 48 receiving the condensate flowing along the surface 46, and the opening 48 forms a part of the central plenum area 42.

Exteriorally, the foot 32 includes a cylindrical axially extending skirt 52 which is in radial spaced relationship to the conical core surface 31 and the skirt and core define an annular well 50 having an access edge 54, FIG. 2, significantly spaced from the foot condensate flow surface 46.

The conical surfaces 34 and 36, of the core 30 and foot 32, respectively, communicate with the well 50 whereby the intersection of the surface 34 with the surface 31 defines an annular inlet 56 for the annular port defined by surfaces 34 and 36 located within well 50, and the significant spacing of the well edge 54 from the drum shell surface 60 will insure the injection of steam into the port inlet 56.

The conduit 22, in communication with a condensate removal and collection means 28, and also being in communication with the central plenum area 42, creates a low pressure therein, thereby facilitating the flow of steam and condensate, by separate paths, into the central plenum area 42. The steam entering the drying drum for the purpose of heating the drum, creates a higher pressure region outside the syphon shoe 18 than that within the syphon shoe. The syphon shoe 18 rotates with the cylinder and maintains its relative position and proximal relationship with the cylinder wall 60 by the spacer legs 44 extending from the shoe condensate flow surface 46 to define the condensate flow path into the shoe 18.

The differential pressure existing between the central plenum area 42 and the area outside the syphon shoe causes condensate to flow between the interior drum wall 60 and the condensate flow surface 46 and into the condensate flow surface opening 48 and the central plenum 42.

In the central plenum area 42, steam is introduced from the well 50 through the annular port outlet 40 and the steam flow is directed toward the shoe condensate flow surface opening 48, which defines the fluid interface adjacent to the drum surface 60, as well as toward the shoe radial axis 58. At the fluid interface adjacent to the drum surface 60 the condensate flowing into the shoe 18 mixes with the injected steam forming a mixture with a lower density than the condensate alone. The reduced density, in conjunction with the direct action of the steam upon the condensate, enhances the condensate removal rate at low differential pressures.

The injection of steam through the annular steam port would be prevented should condensate flood the port inlet 56. The likelihood of such flooding is reduced by the condensate barrier created by the shoe skirt 52 which prevents condensate from laterally intruding into the well 50.

As the steam injection into the syphon 18 is through the annular port outlet 40, and as the spacing between the surfaces 34 and 36 is such as to minimize clogging, the use of the annular port to mix the steam and condensate produces superior low differential pressure condensate removal with rotary syphons as compared with conventional syphon constructions. As the opening 48 and plenum area 42 are unrestricted by baffles or deflectors a complete mixing of the steam and condensate is achieved to lower the condensate density to enhance removal.

It is appreciated that various modifications to the inventive concepts may be apparent to those skilled in the art without departing from the spirit and scope of the invention.

I claim:

1. A low differential rotary syphon assembly for use with steam heated drying drums having an interior wall and condensate therein, comprising in combination, a shoe having a longitudinal axis, said shoe having a condensate flow surface and flow surface spacing means, said condensate flow surface having an opening receiving condensate, said spacing means adapted to maintain said condensate flow surface in opposed juxtaposition to the drying drum interior wall, said shoe including an open unobstructed central plenum in communication with said condensate flow surface opening receiving condensate and having an axis coaxial with said shoe longitudinal axis, at least one steam port defined in said shoe having a steam inlet spaced from said flow surface and an outlet discharging steam into said central plenum toward said condensate flow surface and the drying drum interior wall, whereby, steam ejected from said port mixes with the condensate within said central plenum thereby forming a condensate mass of reduced density which enhances removal of said condensate, and condensate removal means attached to said shoe in communication with said central plenum.

2. In a rotary syphon assembly as in claim 1, a plurality of ports defined in said shoe, said plurality of ports being arranged in a generally annular configuration about said shoe longitudinal axis, each port having an outlet in said shoe central plenum disposed toward said condensate flow surface opening and an inlet communicating with the steam within the drum.

3. In a rotary syphon shoe assembly as in claim 2, an annular extension defined on said shoe defining a skirt, said skirt being radially spaced from said plenum axis and extending away from said condensate flow surface to form an annular well, said skirt having an access edge spaced from said condensate flow surface, said steam port inlets being in communication with said well.

4. In a rotary syphon shoe assembly as in claim 3, said ports comprising an annular opening in said central plenum constituting an outlet, said outlet being disposed toward said condensate flow surface opening, said port inlets comprising an annular opening receiving steam from said well.

5. A low differential rotary syphon assembly for use with steam heated drying drums having an interior wall and condensate therein, a shoe, said shoe comprising, in combination, a foot, said foot having a first conical surface defined thereon, a longitudinal axis and a condensate flow surface adapted to be located in spaced juxtaposition to the drying drum inner wall, said condensate flow surface having an opening receiving condensate, a core, said core having a second conical surface in opposed spaced concentric relationship with said foot surface, said conical surfaces defining an annular steam port, a central plenum defined within said core and said foot in communication with said condensate flow surface opening, said annular steam port defined by said core and said foot conical surfaces having an outlet disposed toward said condensate flow surface opening, and condensate removal means in communication with said central plenum.

6. In a low differential pressure rotary syphon assembly as in claim 5, a plurality of spacers located within said annular steam injection port, said spacers being located between said foot and core conical surfaces to maintain the spacing therebetween.

7. In a low differential pressure rotary syphon assembly as in claim 5, an annular skirt defined on said foot radially spaced from said core forming a well for receiving steam, said well being in communication with said port and said central plenum.

8. In a low differential pressure rotary syphon assembly as in claim 7, said skirt having an access edge being defined by the end of said skirt and defining the access to said well.

* * * * *